United States Patent [19]

Urlberger

[11] 4,190,376

[45] Feb. 26, 1980

[54] FASTENING DEVICE FOR A SAFETY FENCE BEAM

[76] Inventor: Hans Urlberger, Gutwerkstrasse 45, 8750 Aschaffenburg, Fed. Rep. of Germany

[21] Appl. No.: 903,070

[22] Filed: May 5, 1978

[30] Foreign Application Priority Data

May 6, 1977 [DE] Fed. Rep. of Germany ..... 2720414

[51] Int. Cl.[2] ..... E01B 5/18

[52] U.S. Cl. ..... 403/14; 256/13.1; 403/187

[58] Field of Search ..... 256/13.1; 403/262, 187, 403/199, 13, 14

[56] References Cited

U.S. PATENT DOCUMENTS

| | | | |
|---|---|---|---|
| 471,610 | 3/1892 | Hart | 403/403 |
| 2,025,014 | 12/1935 | Brickman et al. | 256/13.1 |
| 2,090,115 | 8/1937 | Ewing | 256/13.1 |
| 2,181,703 | 11/1939 | McCracken | 256/13.1 |
| 2,228,652 | 1/1941 | Dailey | 256/13.1 |
| 2,942,853 | 6/1960 | Glaros | 256/13.1 |

FOREIGN PATENT DOCUMENTS

| | | | |
|---|---|---|---|
| 1293801 | 4/1969 | Fed. Rep. of Germany | 256/13.1 |
| 2304147 | 8/1973 | Fed. Rep. of Germany | 256/13.1 |

*Primary Examiner*—Andrew V. Kundrat

[57] ABSTRACT

Apparatus is disclosed for attachment of a safety fence of the type used for safe deflection of vehicle from leaving a roadway, wherein the apparatus is connected between a post anchored in earth and a safety fence beam. The apparatus includes corrugations for supporting the beam in fixed and unbending relationship and to prevent sagging of the fence structure upon the impact of a vehicle.

6 Claims, 2 Drawing Figures

FASTENING DEVICE FOR A SAFETY FENCE BEAM

BACKGROUND OF THE INVENTION

This invention is an improvement over the invention described in West German Auslegeschrift No. 2 293 801, published Apr. 30, 1969.

The invention relates to a fastening device for a safety fence beam on a post, consisting of at least a flap parallel to a beam or the like, which is provided on the transverse side of a connecting piece fixed between beam and post or such.

A fastening device of this kind with a special safety fence system, a so-called distance safety fence system, generally consists of a flap, which is bent rectangularly from the strap of the connecting piece. This flap is level in itself and has at least one perforation for reception of the fastening means. The beam touches the surface area with a flap and is connected with the latter mostly with rivets or the like. It is known that in spite of the screw joining or other means of fastening, relative motion occurs between beam and fastening flap to a certain degree.

An object of the invention is to prevent this relative motion in a simple and economical way.

SUMMARY OF THE INVENTION

The problem is thus solved, that according to the invention the fastening flap has at least one linear bulge, corrugation, bead, etc., or at least two point-shaped bulges or such, parallel to each other.

These cross-sectional corrugations are formed in the fastening flap at a distance from a borehole in the flap for receiving the fastening means for supporting the beam and thereby aid in supporting the beam. Vertical shifting and/or twisting of the beam on the connecting piece is virtually avoided in the simplest way and an exactly defined position of the beam on the connecting piece is guaranteed.

By supporting the beam on the corresponding corrugation, bead or such, the supporting screw or the rivet which connects the beam with the connecting piece is relieved.

With a tensile load on the beam the fastening flaps are bent up less quickly, and a certain frame stiffness is reached which has an especially favorable effect on the sagging of the whole safety fence structure when a vehicle strikes it, thereby avoiding possible deeper bulges to a great extent, which could form permanent dents and cause the vehicle to come to a sudden standstill.

Accordingly, it has been proven especially appropriate when the corrugation, bead or such is provided on the beamside.

In a second embodiment of the invention two corrugations, beads, etc. are provided, the spacing of which is adjusted to the width of the contact area of the beam.

Furthermore, only the beamside edges of the corrugations, beads, etc. need to run parallel to each other.

In the present invention of a connecting piece, from which the fastening flaps are bent rectangularly, the corrugation, bead, etc. can start from the strap of the connecting piece and end in the flap, according to an appropriate design, and the bulge, corrugation, bead, etc. or the pointshaped bulges parallel to each other or such are arranged prominently in the longitudinal direction of the beam.

BRIEF DESCRIPTION OF THE DRAWINGS

The drawings illustrate the preferred design of the invention, in which.

DESCRIPTION OF THE PREFERRED EMBODIMENT

Figure 1:
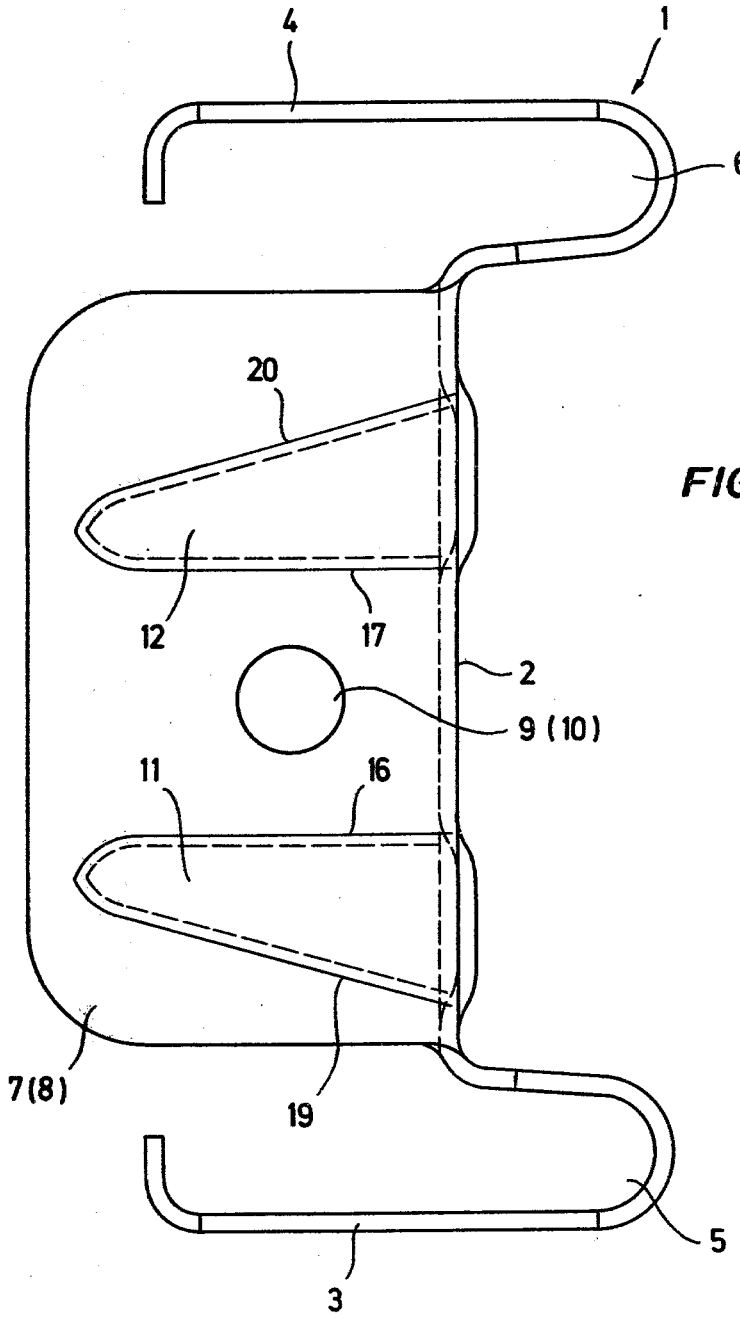
FIG. 1 shows a transverse view on a connecting piece with a fastening flap.
Figure 2:
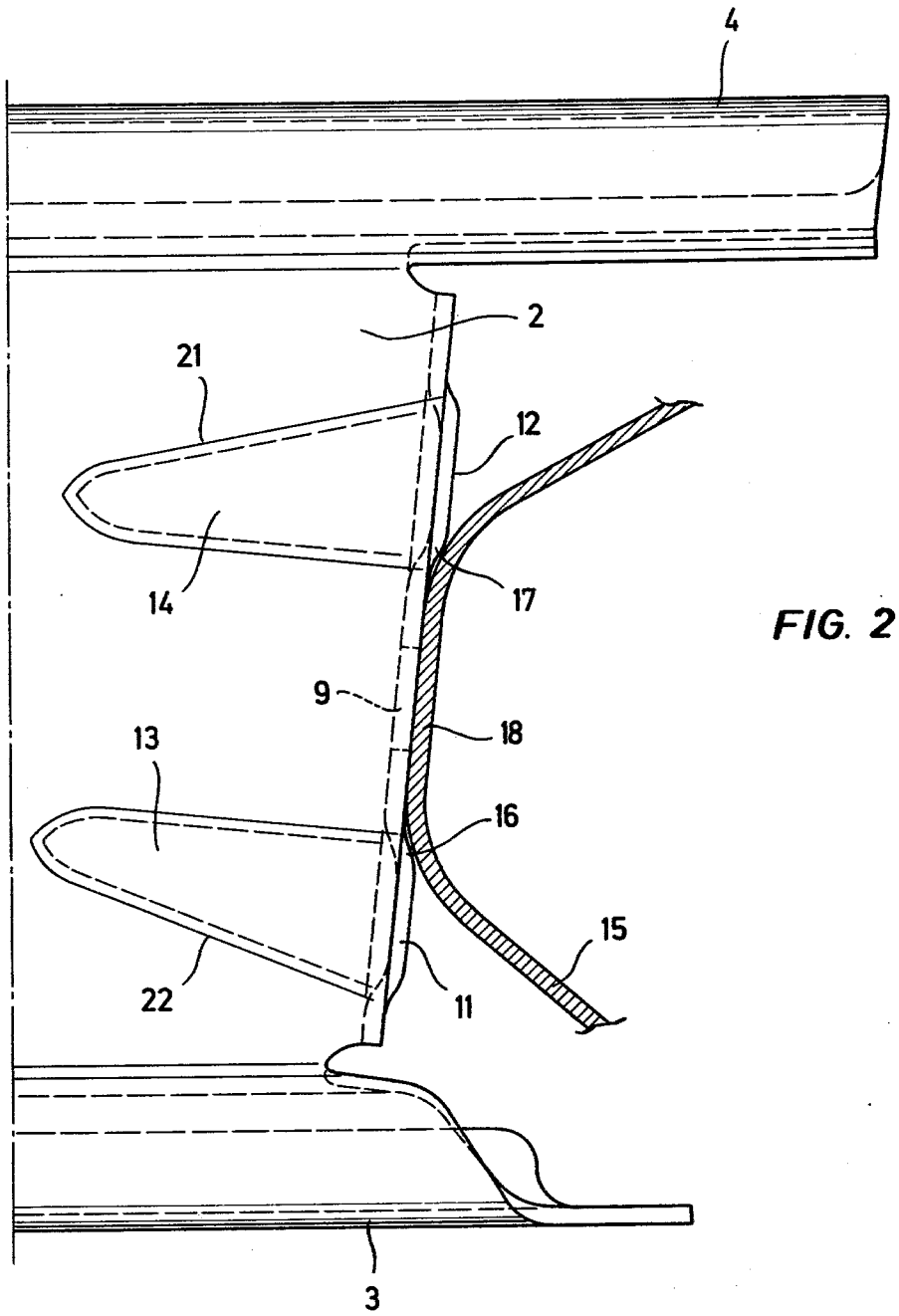
FIG. 2 shows a one-half side view on the same connecting piece, with a part of a beam.

Referring to the drawings, a connecting piece 1 consists of a platelike strap part and two offset sides 3 and 4. The sides 3 and 4 are connected over an arc-shaped area 5 and 6 with the strap part which in the presented model is formed from a flat plate. FIG. 2 shows a side view of one-half the connecting piece 1, the other one-half being formed as a mirror image about the center line shown on the figure.

The individual ends of the connecting piece are provided with fastening flaps 7 and 8 which are rectangularly bent from the strap or strap part 2 and which have a hole 9, 10 for reception of the fastener. The fastening flap 7 shows a nearly rectangular form and is provided with two beads 11 and 12. Both beads are produced before the bending of the fastening flap 7 and accordingly extend, as is evident from FIG. 2, into the strap part 2. Accordingly beads 13 and 14 are in the area that borders on the fastening flap.

The beads are bulged in direction to a beam 15 and show slanted areas 16 and 17 which run parallel to each other. The slanted areas are designed in such a way that with contacting the middle section 18 of the beam 15 it is guaranteed that the beam 15 can neither turn around the central axis of the fastening means nor move in vertical or near vertical direction.

The slanted areas 19, 20, and 21, 22 which are respectively on the beads 11, 12, 13 and 14 run along an acute angle relative to the slanted areas 16 and 17 respectively in contact position to the longitudinal axis of the beam 15.

In addition to the herein-described beads that run in longitudinal direction of the beam, other corrugations of various kinds can of course be contained on the fastening flaps. It also is not necessary that the beads are formed throughout; it is possible that the indentations are formed at points, for example lying perpendicular next to each other. Furthermore, it is not necessary that the fastening flap is connected in one piece with the connecting piece, it can also be contained as a separate part and then be attached with the connecting piece.

It is also possible to provide a bulge in the fastening flap which is directed to the side that is turned away from the beam and has such measurements that the central area of the beam 15 fits exactly in this bulge.

Also, according to the invention, it is possible that the locking aide for the beam not be contained on the fastening flap, but instead on a connecting plate of a correspondingly formed connecting piece, and attached to the fastening flap.

What is claimed is:

1. In a fastening device for attaching a safety fence beam to a post wherein the fastening device is positioned intermediate the beam and post and includes transverse surfaces respectively attachable to the beam and post, the improvement comprising at least one corrugation in the surface attachable to said beam, said corrugation having a raised edge in aligning and supporting relation to said beam.

2. The improvement of claim 1, further comprising a second corrugation in the surface attachable to said beam, said second corrugation having a raised edge in parallel with said first corrugation raised edge and in aligning and supporting relation to said beam, said beam being attachable to said surface between said raised edges.

3. The improvement of claim 2 wherein said first and second corrugations have respective additional non-parallel raised edges spaced away from said beam.

4. The improvement of claim 3, further comprising additional corrugations in the surface attachable to said post, said additional corrugations respectively forming transverse extensions of said first and second corrugations.

5. The improvement of claim 4, wherein each of said additional corrugations respectively comprise non-parallel raised edges in the surface facing away from said post attachment surface.

6. The improvement of claim 5, wherein each of said additional corrugations respectively form a continuous extension of said first and second corrugations.

* * * * *